US006901724B2

(12) United States Patent
Tale'et al.

(10) Patent No.: US 6,901,724 B2
(45) **Date of Patent: *Jun. 7, 2005**

(54) METHOD AND UNIT FOR TRANSFERRING WRAPPINGS

(75) Inventors: Fabrizio Tale', Bologna (IT); Mario Spatafora, Bologna (IT)

(73) Assignee: G.D. Societa' Per Azioni, Bologna (IT)

( * ) Notice: Subject to any disclaimer, the term of this patent is extended or adjusted under 35 U.S.C. 154(b) by 0 days.

This patent is subject to a terminal disclaimer.

(21) Appl. No.: 10/315,917

(22) Filed: Dec. 10, 2002

(65) Prior Publication Data

US 2003/0132083 A1 Jul. 17, 2003

(30) Foreign Application Priority Data

Dec. 12, 2001 (IT) ..... BO2001A0752

(51) Int. Cl.[7] ..... B65B 49/00

(52) U.S. Cl. ..... 53/461; 53/444; 53/466; 53/443; 53/234; 53/251; 53/252; 53/376.2

(58) Field of Search ..... 226/173; 198/598, 198/608; 414/749.1; 53/466, 461, 443, 444, 234, 250, 252, 415, 449, 491, 173, 228, 376.2

(56) References Cited

U.S. PATENT DOCUMENTS 3,380,227 A * 4/1968 Youngman et al. ..... 53/171
5,946,890 A * 9/1999 Focke et al. ..... 53/466
5,996,309 A * 12/1999 Focke et al. ..... 53/228
6,186,313 B1 * 2/2001 Spatafora et al. ..... 198/474.1
6,263,644 B1 * 7/2001 Ghini et al. ..... 53/463
6,324,817 B1 * 12/2001 Ghini et al. ..... 53/466
6,470,651 B1 * 10/2002 Polazzi et al. ..... 53/466
6,513,533 B2 * 2/2003 Spatafora et al. ..... 131/283
6,606,840 B2 * 8/2003 Focke et al. ..... 53/461
6,643,996 B2 * 11/2003 Spatafora et al. ..... 53/466
6,708,466 B2 * 3/2004 Spatafora ..... 53/466

FOREIGN PATENT DOCUMENTS

| | | |
|---|---|---|
| EP | 0854084 | 7/1998 |
| EP | 1153835 | 11/2001 |

* cited by examiner

*Primary Examiner*—Scott A. Smith
*Assistant Examiner*—Brian D Nash
(74) *Attorney, Agent, or Firm*—Ladas & Parry LLP

(57) ABSTRACT

A method of transferring wrappings, wherein each wrapping is defined by a sheet of wrapping material and has at least one flat wall, provides for feeding a wrapping along a curved path by means of a pocket of a conveyor; for guiding the wrapping along the curved path by means of a guide contacting the wrapping; and for moving a plate of the guide with respect to the pocket, so that a flat face of the plate is maintained contacting the entire flat wall of the wrapping along a portion of the curved path.

15 Claims, 6 Drawing Sheets

METHOD AND UNIT FOR TRANSFERRING WRAPPINGS

The present invention relates to a method of transferring articles hereafter referred to as wrappings.

The present invention may be used to advantage for transferring articles or so-called wrappings consisting of groups of cigarettes, each partly or fully enclosed in a sheet of wrapping material, to which the following description refers purely by way of example.

BACKGROUND OF THE INVENTION

A sheet of wrapping material wrapped about a group of cigarettes comprises a flat wall defined by a portion of the sheet of wrapping material contacting the group.

One known method of transferring wrappings of the above type comprises feeding the wrappings along a path by means of a pocket conveyor, each pocket of which houses a wrapping having a flat wall substantially free of the pocket; and guiding the wrappings by means of a guide facing the pockets and contacting the wrappings along said path.

When the pockets travel along a straight path, the guide is defined by a fixed plate having a flat sliding face, along which the wrapping slides in use. Automatic machine manufacturers, however, prefer to transfer packets of cigarettes on wheel conveyors, which are more reliable than chain or belt conveyors, so that the path of the pockets and relative fixed guide is curved as opposed to straight. Though performing the same functions as a straight guide, such as retaining the wrappings inside the pockets, a curved guide has disadvantages caused by the flat wall of the wrapping sliding along a curved sliding surface of the guide, so that the wrapping contacts the guide at edges on opposite sides of the flat wall. Just some of the disadvantages of the wrapping contacting the guide in this way are wear of the wrapping along the edges, deformation of the edges, and deformation of the flat wall, which tends to reproduce the curve of the guide under the centrifugal force of the group of cigarettes.

Deformation of the flat wall is further compounded when the wrapping, as it travels along the curved path, is subjected to folding, e.g. finish folding, operations which may induce deformation along the flat wall. In particular, folding portions of the wrapping directly connected to the flat wall induce deformation of the flat wall, unless the whole of the flat wall is supported.

SUMMARY OF THE INVENTION

It is an object of the present invention to provide a method of transferring wrappings with flat walls along paths having a curved portion, and designed to eliminate the drawbacks of the known state of the art.

According to the present invention, there is provided a method of transferring wrappings, wherein each wrapping is defined by at least one sheet of wrapping material and comprises at least one flat wall; the method comprising the steps of feeding a wrapping along a curved path by means of a pocket of a conveyor, and guiding the wrapping along said curved path by means of a guide contacting said wrapping; and the method being characterized by moving a plate of said guide with respect to said pocket, so that a flat face of said plate contacts the entire flat wall of said wrapping along a portion of said curved path.

The present invention also relates to a unit for transferring wrappings.

According to the present invention, there is provided a unit for transferring wrappings, wherein each wrapping is defined by at least one sheet of wrapping material and comprises at least one flat wall; the unit comprising a conveyor, in turn comprising at least one pocket for feeding a wrapping along a curved path, and a guide for guiding the wrapping along said curved path; and the unit being characterized in that said guide comprises at least one plate having a flat face and movable with respect to the conveyor to keep said flat face in contact with the entire flat wall of said wrapping along a portion of said curved path.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
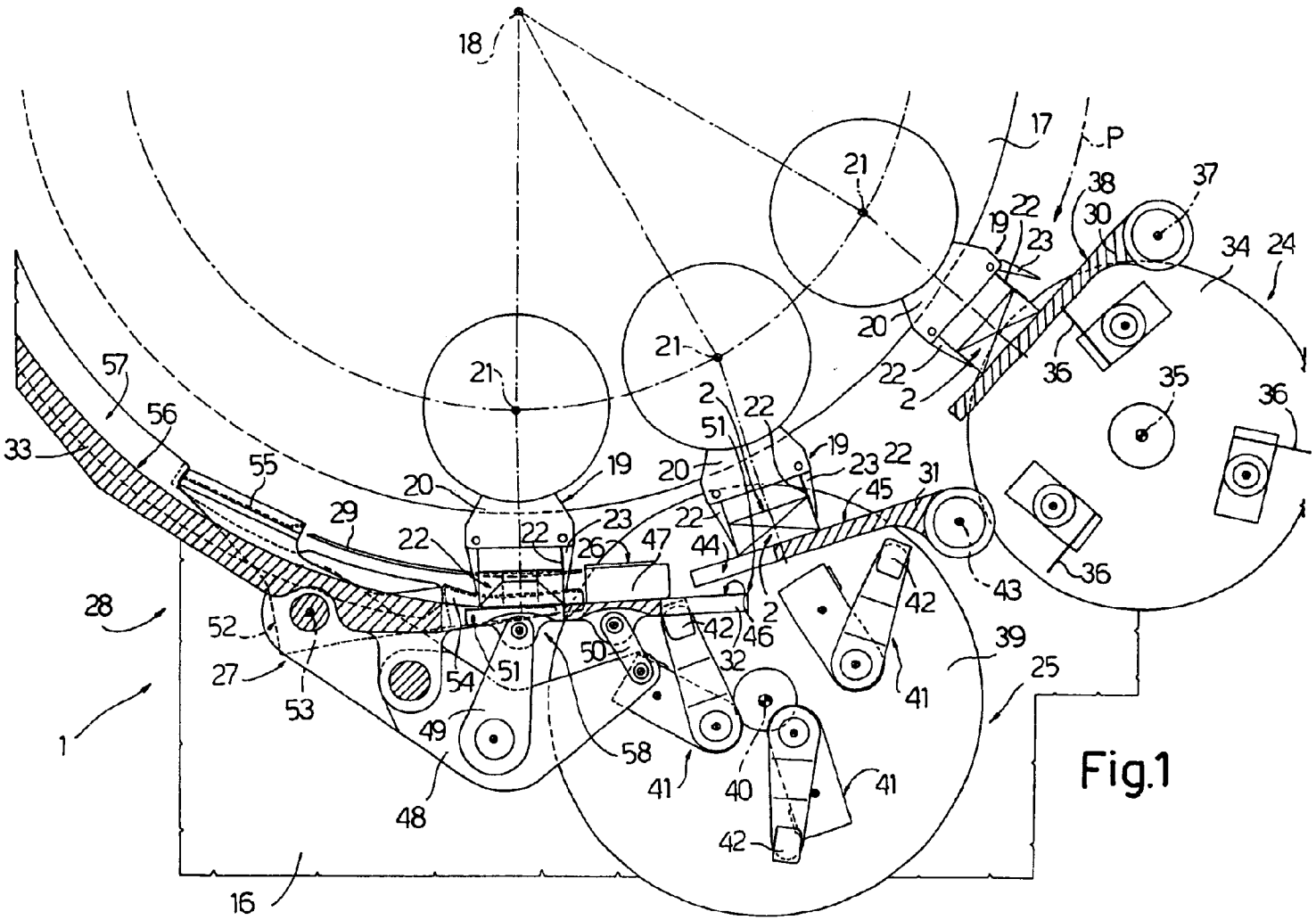
FIG. 1 shows a schematic side view, with parts in section and parts removed for clarity, of a unit for implementing the method according to the present invention.
Figure 8:
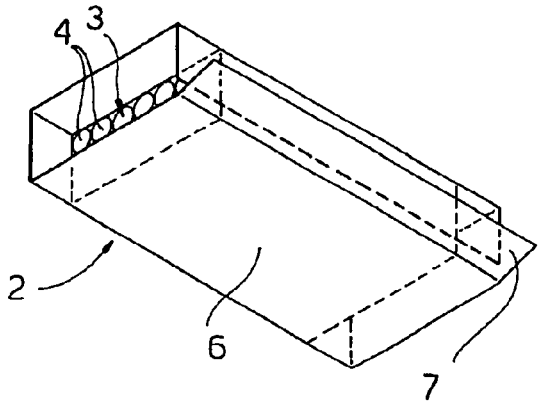
FIGS. 8 to 12 show views in perspective of a wrapping at successive finishing stages.
Figure 11:
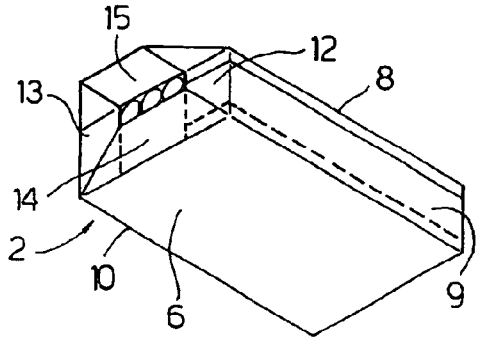
Figure 9:
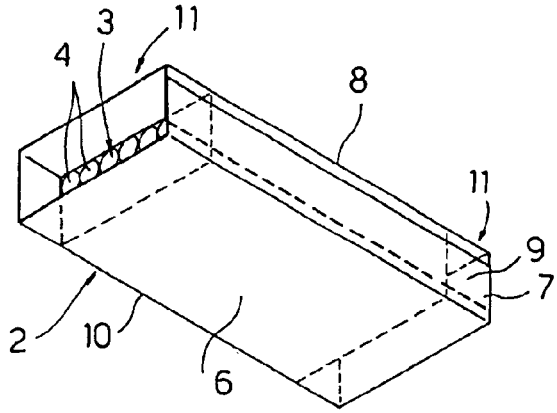
Figure 12:
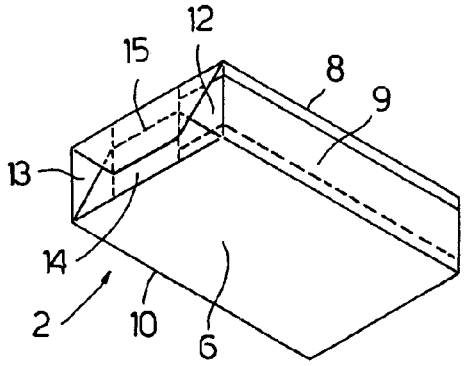
Figure 10:
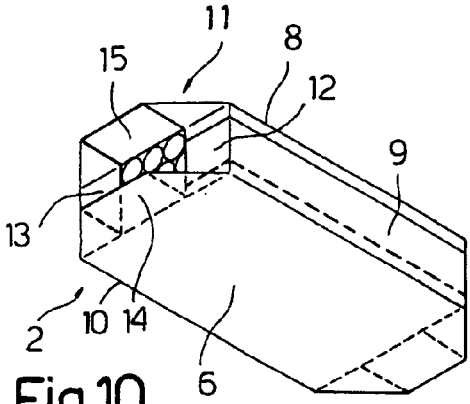

Number 1 in FIG. 1 indicates as a whole a unit for transferring wrappings 2 along a curved path P; each wrapping 2 comprising an orderly group 3 of cigarettes 4 wrapped in a sheet 5 of wrapping material. With reference to FIGS. 8 to 12, sheet 5 is wrapped gradually about group 3 in a number of folding operations. In FIG. 8, sheet 5 of wrapping material is folded partly into a tube about group 3, and defines, among other things, a flat wall 6 contacting group 3, and a free portion 7 adjacent to flat wall 6. In FIG. 9, portion 7 is folded squarely with respect to wall 6, so that wrapping 2 is in the form of a tube having four walls 6, 8, 9 and 10 in parallel pairs, and two tubular end portions 11 projecting with respect to group 3. In FIG. 10, two tabs 12 and 13 of each tubular portion 11 are folded onto group 3 so that each tubular portion 11 has opposite tabs 14 and 15. In FIG. 11, each tab 14 is folded onto group 3 and overlaps tabs 12 and 13. And in FIG. 12, tabs 15 are folded onto group 3 and overlap tabs 14.

With reference to FIG. 1, the various configurations of wrapping 2 described with reference to FIGS. 8 to 12 are achieved as wrapping 2 is fed along path P by unit 1. Unit 1 comprises a frame 16, and a wheel 17 rotating about an axis 18 perpendicular to the FIG. 1 plane, and supports a succession of pockets 19 equally spaced about axis 18 and for retaining respective wrappings 2. Each pocket 19 comprises a supporting frame 20 rotating about an axis 21 parallel to axis 18; two lateral walls 22 rotating with respect to frame 20 about respective axes (not shown) parallel to axis 18; and a jaw 23 for retaining free portion 7 against a blade-shaped wall 22. Each pocket 19 retains a respective wrapping 2 so that wall 6 of each wrapping faces outwards of wheel 17.

Unit 1 also comprises, in succession along path P, four folding devices 24, 25, 26 and 27, which cooperate with a guide 28 and provide for folding portion 7 and tabs 12, 13, 14 and 15 of each wrapping 2 as wrapping 2 travels in contact with guide 28, which comprises two fixed bars 29, three movable plates 30, 31 and 32, and a fixed channel 33.

Folding device 24 comprises a wheel 34 rotating about an axis 35 parallel to axis 18; and three folding blades 36 equally spaced about axis 35. Plate 30 extends between wheel 17 and folding device 24, rotates about an axis 37 parallel to axis 18, is comb-shaped for engagement by blades 36, and has a flat sliding face 38 facing the periphery of wheel 17.

Folding device 25 comprises a wheel 39 rotating about an axis 40; and three articulated arms 41 equally spaced about axis 40, and which open in the form of a fork, each supporting two folding members 42. Plate 31 extends between folding device 25 and wheel 17, rotates about an axis 43, and comprises a toothed end 44 and a flat sliding face 45.

Plate 32 has a flat sliding face 46 facing wheel 17, and supports folding device 26, which comprises two blades 47, each extending perpendicularly to face 46 and supported over plate 32 by a flange integral with plate 32. Plate 32 is connected to frame 16 by a beam 48, which is fixed with respect to frame 16 and forms, with plate 32 and two arms 49 and 50 of different lengths, an articulated linkage assembly of quadrilateral form for varying the orientation of plate 32. Arm 49 rotates about an axis 49*a* parallel to axis 18, and is connected to a known actuator (not shown) to move plate 32 with respect to wheel 17. Plate 32 also comprises two toothed ends 51.

Folding device 27 comprises two rocker arms 52, only one of which is shown in FIG. 1. Each rocker arm 52 is hinged to beam 48 about an axis 53 parallel to axis 18, and comprises two folding members 54 and 55. Fixed channel 33 extends partly between folding device 27 and wheel 17, and comprises a curved face 56 parallel to the periphery of wheel 17; two flat parallel circular faces 57, only one of which is shown in FIG. 1; and a toothed inlet portion 58 which cooperates with a toothed end 51 of plate 32.

Wheel 17, pockets 19, movable plates 30, 31, 32, and folding devices 24, 25, 27 are operated by respective known actuators not shown in the accompanying drawings.

In actual use, and with reference to FIG. 1, wheel 17 is rotated clockwise about axis 18 to feed wrappings 2 along curved path P, along which guide 28 is located. Along a first portion of path P, a wrapping 2 facing plate 30 is guided by plate 30 itself, which is oriented clockwise about its axis 37. At the same time, pocket 19 is oriented anticlockwise about axis 21 to keep flat wall 6 of wrapping 2 parallel to and contacting flat face 38 of plate 30. As wrapping 2 slides along face 38, a blade 36 of folding device 24 engages plate 30 comb-fashion and folds portion 7 squarely with respect to wall 6 to obtain the wrapping 2 configuration shown in FIG. 9. Jaw 23 is then closed to hold portion 7 in the folded position.

Upon wrapping 2 leaving plate 30, pocket 19 is rotated clockwise about axis 21 to set wrapping 2 to a suitable position to slide along plate 31, and plate 30 is rotated anticlockwise about axis 37 into a suitable position to receive the in-coming wrapping 2 of the next pocket 19. In other words, the wrapping 2 retained by pocket 19 "skips" between successive plates 30 and 31 to allow pocket 19 and plate 30 to "rearm".

Wall 6 of wrapping 2 slides along flat face 45 of plate 31 by virtue of plate 31 and pocket 19 rotating simultaneously as described above with reference to plate 30.

Figure 2:
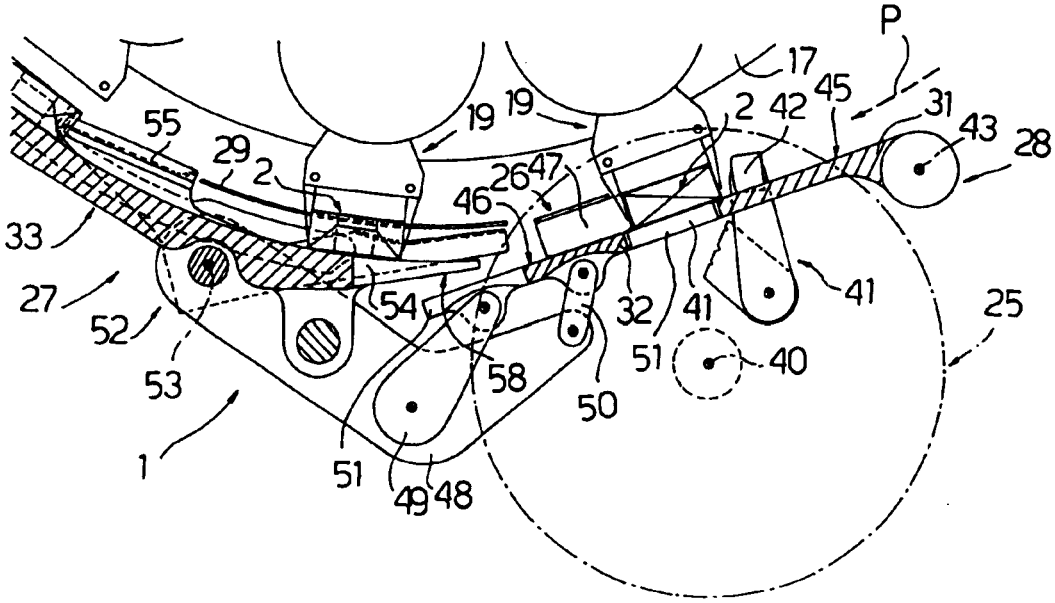
FIGS. 2 to 5 show side views of a detail of the FIG. 1 unit at different operating stages.
Figure 3:
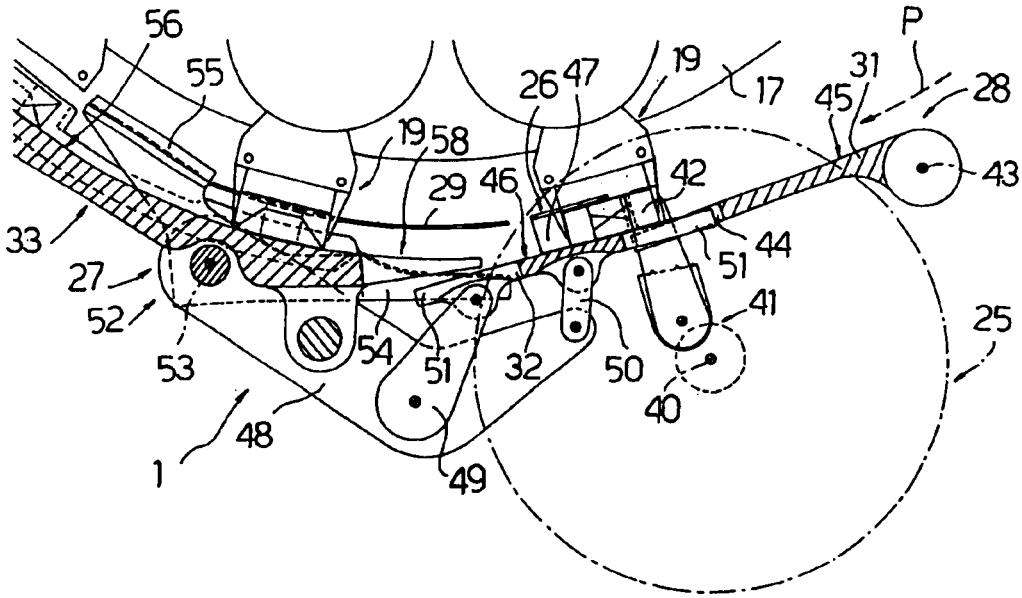

With reference to FIG. 2, as wrapping 2 slides along plate 31, two folding members 42 are moved into position over plate 31 and follow wrapping 2. At the same time, arm 49 is rotated clockwise with respect to beam 48, and tilts plate 32 so as to align face 46 of plate 32 with face 45 of plate 31 and intersect ends 44 and 51. FIG. 2 shows plates 31 and 32 in the aligned position. Plate 31 is then rotated anticlockwise, and plate 32 takes over from plate 31 in guiding wrapping 2, as shown in FIG. 3. Arm 49 is now rotated anticlockwise with respect to beam 48, while pocket 19 is maintained in a fixed position, so that the articulated linkage assembly of quadrilateral form defined by beam 48, by plate 32, and by arms 49 and 50, keeps face 46 parallel to and in contact with wall 6 of wrapping 2 to allow wall 6 to slide along face 46. With reference to FIG. 3, as it slides along face 46, wrapping 2 engages blades 47 of folding device 26, and the two folding members 42 on either side of plate 32 catch up with wrapping 2 to fold respective tabs 13 and 12 and so obtain the configuration of wrapping 2 shown in FIG. 10.

Figure 4:
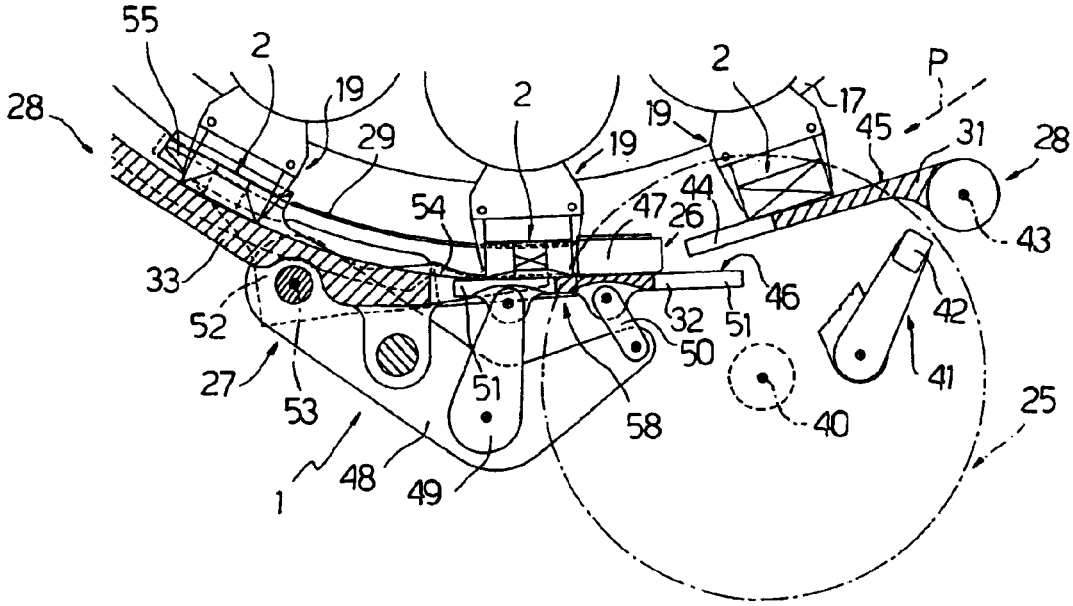
Figure 5:
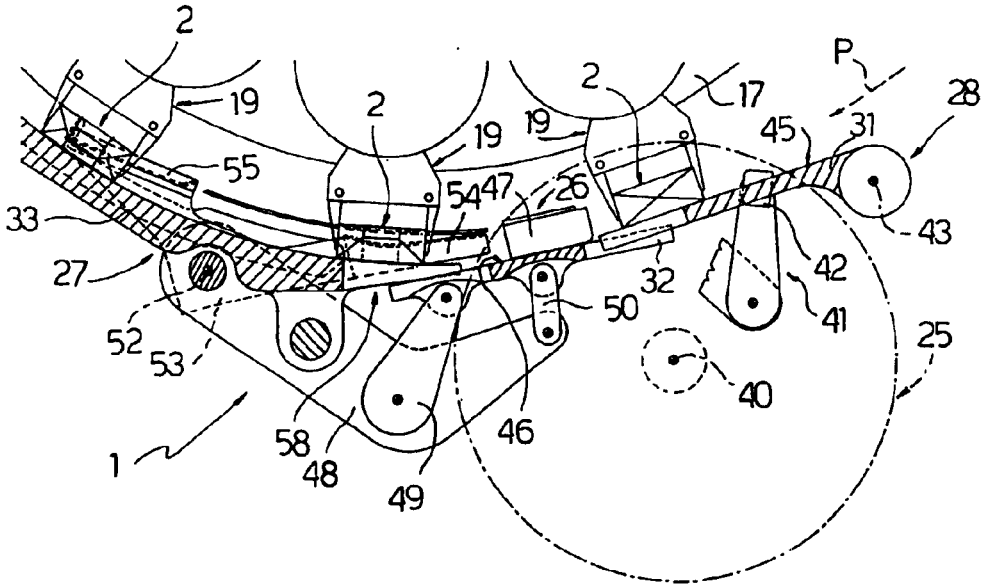

With reference to FIG. 4, gradual anticlockwise rotation of arm 49 causes end 51 of plate 32 to engage portion 58 of channel 33. That is, face 46 is positioned tangent to curved face 56 of channel 33 to transfer wrapping 2 to channel 33. At this stage, in which wall 6 contacts flat face 46 of plate 32, wrapping 2 engages bars 29, which are positioned directly beneath tabs 15, and rocker arm 52 is swung anticlockwise about axis 53 so that folding members 54 fold tabs 14 into the FIG. 11 configuration. Once tab 14 is folded, wrapping 2 is transferred to channel 33, along which tab 15 is folded by member 55 of rocker arm 52 to obtain the FIG. 12 configuration of wrapping 2. The completed wrapping 2 is then fed along channel 33, between opposite circular faces 57 and curved face 56, and, once wrapping 2 is transferred to channel 33, plate 32 is again tilted, by arm 49 rotating clockwise, to receive the next wrapping 2 from plate 31, as shown in FIG. 5.

As wrapping 2 is fed along curved path P, guide 28 provides, by virtue of movable plates 30, 31, 32, for supporting substantially the whole of wall 6, with respect to which portion 7 and tabs 12, 13, 14 are folded, thus preventing wall 6 from being deformed, as it would be with no support at all.

Figure 6:
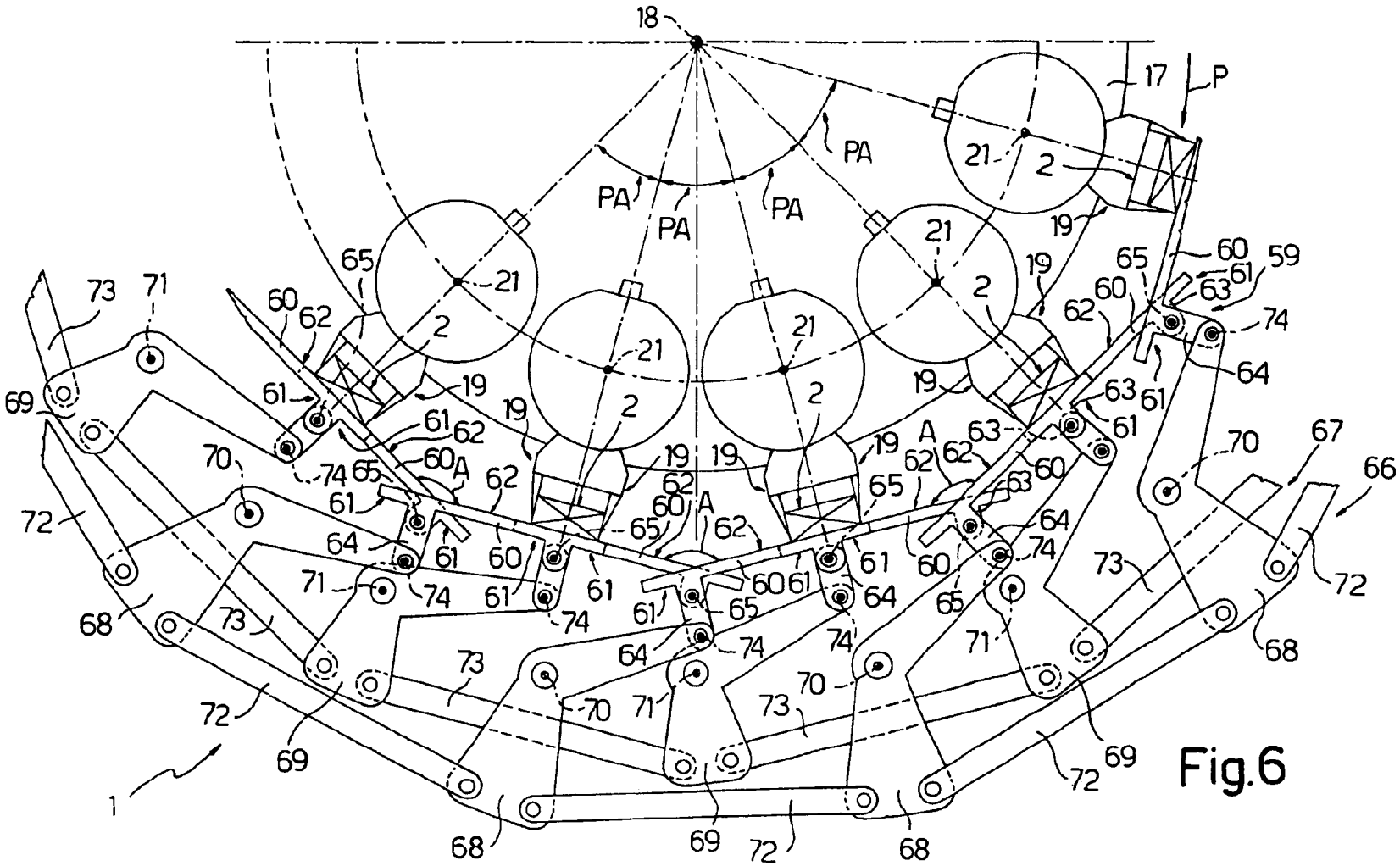
FIGS. 6 and 7 show side views, with parts in section and parts removed for clarity, of two operating stages of a variation of the FIG. 1 unit.

In the FIG. 6 variation, unit 1 has no folding devices 24, 25, 26, 27, and guide 28 is replaced by a guide 59 for simply guiding wrappings 2 along path P, and which comprises a number of articulated plates 60. Each plate 60 comprises toothed opposite ends 61 which engage with the toothed ends 61 of the adjacent plates 60; a flat sliding face 62; and, on the opposite side to face 62, two arms 63, 64 connected rigidly to plate 60. Arm 63 is shorter than arm 64, and is hinged to arm 64 of the adjacent plate 60 about an axis 65 parallel to axis 18 of wheel 17.

Guide 59 comprises two transmissions 66 and 67, which have two respective successions of rocker arms 68 and 69 pivoting about respective axes 70 and 71 and connected in pairs by respective rods 72 and 73.

Rocker arms 68 and 69 alternate about wheel 17, and are connected to alternate plates 60. That is, one rocker arm 68 is hinged about an axis 74 to an arm 64 of a given plate 60, and two rocker arms 69 adjacent to rocker arm 68 are hinged about axes 74 to arms 64 of two plates 60 adjacent to said given plate 60. In other words, each plate forms part of an articulated linkage assembly of a pentagon form comprising the frame, rocker arm 68, rocker arm 69, arm 64 of the adjacent plate 60, and plate 60 itself.

One of rocker arms 68 in succession 66 is connected to a known actuator (not shown), e.g. a cam actuator driven by the rotation of wheel 17. One of rocker arms 69 is driven in the same way; and connection of rocker arms 68 and 69 by rods 72 and 73 provides for driving all the rocker arms 68 and 69 simultaneously using only two actuators.

Pockets 19 are equally spaced along the periphery of wheel 17 with an angular spacing PA, while plates 60 are equally spaced about axis 18 with an angular spacing of PA/2.

Figure 7:
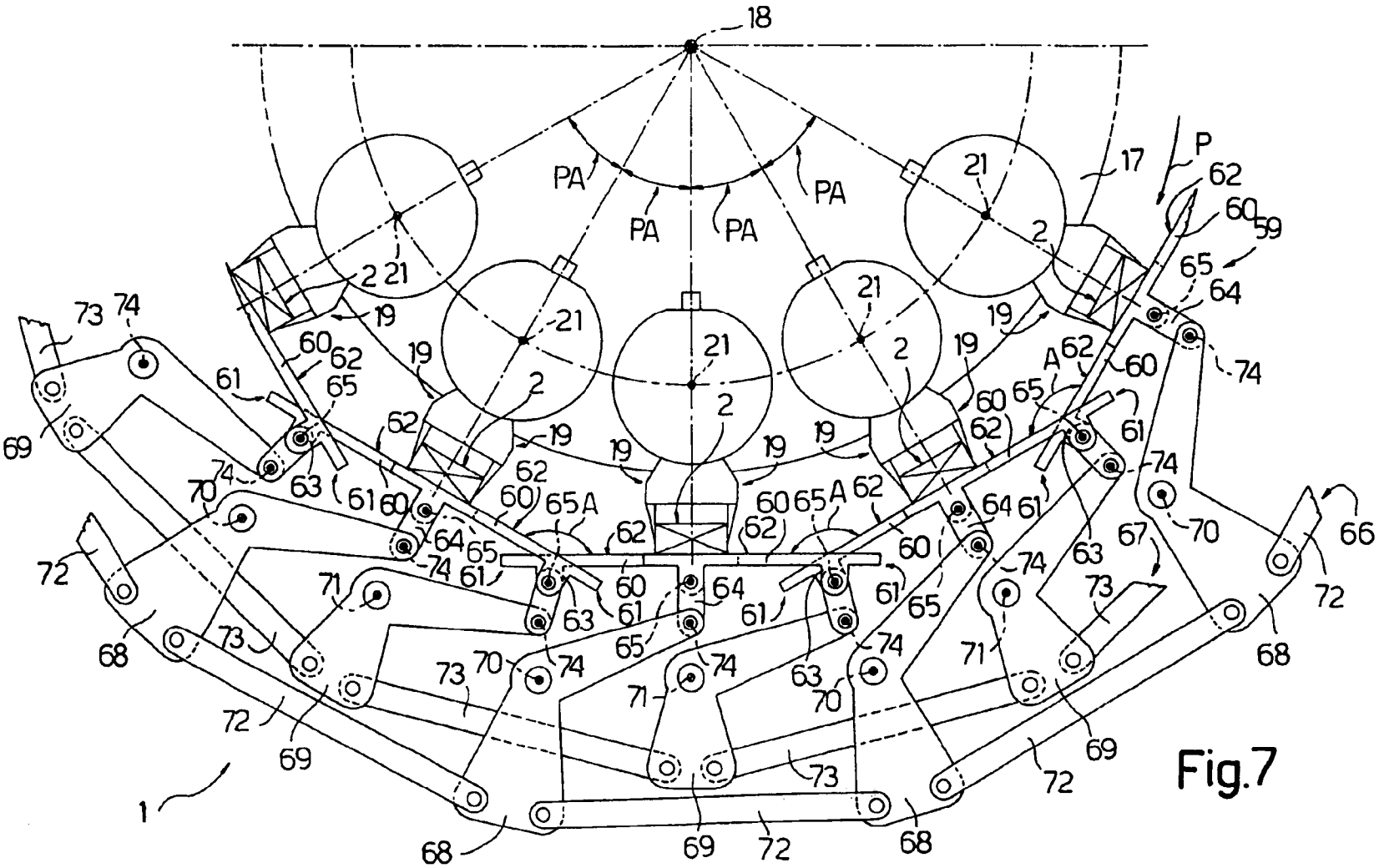

In actual use, wheel 17 is rotated continuously about axis 18 to feed the wrappings along curved path P, with flat wall 6 of each wrapping 2 facing outwards of wheel 17 and contacting plates 60. With reference to FIG. 6, plates 60 are aligned in pairs, and wrappings 2 are located at ends 61 of two aligned plates 60 so that walls 6 simultaneously contact two adjacent plates 60. The pairs of aligned plates 60 form an angle A with the adjacent pairs of aligned plates 60, but the angle A area is not traveled over by wrappings 2. As wheel 17 rotates clockwise in FIG. 6, wrappings 2 are fed along path P, and, at the same time, rocker arms 68 rotate anticlockwise and rocker arms 69 clockwise, so that faces 62 of plates 60 are kept contacting walls 6 with no need to orient pockets 19 about axes 21, and the adjacent plates 60 forming angle A in the FIG. 6 configuration are aligned. With reference to FIG. 7, rotation of wheel 17 by an angle of PA/2 aligns the plates 60 forming angle A in FIG. 6, and forms an angle A between the adjacent plates 60 aligned in FIG. 6. Further rotation of wheel 17 by an angle PA/2 produces two, respectively clockwise and anticlockwise, rotations of rocker arms 68 and 69 to restore plates 60 to the FIG. 6 configuration. That is, at each rotation by an angle PA, rocker arms 68 and 69 perform two opposite back and forth movements.

What is claimed is:

1. A method of transferring wrappings, wherein each wrapping (2) comprises a product (3) wrapped in at least one sheet of wrapping material (5) having at least one flat wall (6); the method comprising the steps of inserting said wrapping (2) into a pocket (19) of a conveyor (17);

feeding the wrapping (2) along a curved path (P) by means of the pocket (19) of the conveyor (17), guiding the wrapping (2) along said curved path (P) by means of a guide (28; 59) contacting said wrapping (2); and moving a plate (30, 31, 32; 60) of said guide (28; 59) with respect to said pocket (19), so that a flat face (38, 45, 46; 62) of said plate (30, 31, 32; 60) contacts the entire flat wall (6) of said wrapping (2) along a portion of said curved path (P).

2. A method as claimed in claim 1, wherein said conveyor is a wheel (17); the method further comprising rotating said wheel (17) continuously about a first axis (18), and orienting said plate (30, 31, 32; 60) about at least one second axis **(37, 43, 49*a*; 70, 71) parallel to the first axis (18)**.

3. A method as claimed in claim 2, wherein said pocket (19) is hinged to said wheel (17) about a third axis (21) parallel to said first axis (18); the method further comprising simultaneously orienting said plate (30, 31) about said second axis (37, 43), and said pocket (19) about said third axis (21).

4. A method as claimed in claim 1, wherein said plate (32; 60) forms part of an articulated assembly formed as a polygon; the method further comprising moving said plate (32; 60) by means of said articulated assembly.

5. A method as claimed in claim 4, wherein said articulated assembly is formed as a quadrilateral having two arms (49, 50) of different lengths.

6. A method as claimed in claim 4, wherein said articulated assembly is formed as a pentagon.

7. A method as claimed in claim 1, wherein said plate (30, 31, 32) cooperates with folding devices (24, 25, 26, 27).

8. A method as claimed in claim 7, wherein said plate (30) is comb-shaped; and a first folding tool (36) of said folding devices (24, 25, 26, 27) is comb-shaped for engaging said plate (30).

9. A method as claimed in claim 7, wherein second and third folding tools (42, 54) are located on opposite sides of said plate (31, 32) for cooperating therewith.

10. A method as claimed in claim 1, wherein said conveyor (17) comprises a succession of equally spaced pockets (19), wherein each pocket (19) houses a respective wrapping (2) along said curved path (P); said guide (28; 59) comprising a succession of plates (30, 31, 32; 60) located along said curved path (P); and the method further comprising transferring each wrapping (2) between two adjacent plates (30, 31, 32; 60).

11. A method as claimed in claim 10, further comprising the step of detaching said wrapping (2) from said plates (30, 31) to transfer said wrapping (2) between two adjacent plates (30, 31).

12. A method as claimed in claim 10, further comprising the step of aligning faces (45, 46; 62) of said adjacent plates (31, 32; 60) to transfer the wrapping (2) between the adjacent plates (31, 32; 60).

13. A method as claimed in claim 12, wherein adjacent ends (44, 51; 61) of the plates (31, 32; 60) are comb-shaped for engaging one another.

14. A method as claimed in claims 2, comprising spacing said pockets (19) about the first axis (18) with a first angular spacing (PA); said plates (60) about said first axis (18) with a second angular spacing equal to half the first angular spacing (PA).

15. A method as claimed in claim 14, further comprising the step of simultaneously activating said plates (60) by means of a first and a second transmission (66, 67); connecting said plates (60) to one another.

* * * * *

UNITED STATES PATENT AND TRADEMARK OFFICE

CERTIFICATE OF CORRECTION

PATENT NO. : 6,901,724 B2
DATED : June 7, 2005
INVENTOR(S) : Fabrizio Tale et al.

It is certified that error appears in the above-identified patent and that said Letters Patent is hereby corrected as shown below:

Title page,
Item [73], Assignee, "G.D." should read -- G. D --.

Signed and Sealed this

Thirteenth Day of December, 2005

JON W. DUDAS
*Director of the United States Patent and Trademark Office*